United States Patent [19]

Okamoto et al.

[11] 4,318,949

[45] Mar. 9, 1982

[54] COMPOSITE NAP SHEET AND PROCESS FOR PREPARING THE SAME

[75] Inventors: Miyoshi Okamoto, Takatsuki; Mineto Fushida, Shiga, both of Japan

[73] Assignee: Toray Industries, Inc., Tokyo, Japan

[21] Appl. No.: 135,295

[22] Filed: Mar. 31, 1980

Related U.S. Application Data

[63] Continuation of Ser. No. 907,118, May 19, 1978, abandoned, and a continuation-in-part of Ser. No. 830,426, Sep. 6, 1977, abandoned.

[51] Int. Cl.[3] ..... B32B 5/02

[52] U.S. Cl. ..... 428/91; 156/72; 156/154; 156/155; 156/296; 428/96; 428/97; 428/904

[58] Field of Search ..... 428/85, 91, 96, 97, 428/378, 373, 380, 904; 156/72, 15 X, 155, 296, 181, 162, 168; 28/159

[56] References Cited

U.S. PATENT DOCUMENTS

| | | | |
|---|---|---|---|
| 2,390,386 | 12/1945 | Radford | 428/91 |
| 3,705,226 | 12/1972 | Okamoto et al. | 428/91 |
| 3,865,678 | 2/1975 | Okamoto et al. | 428/91 |
| 3,932,687 | 1/1976 | Okamoto et al. | 428/288 |
| 4,051,287 | 9/1977 | Hayashi et al. | 428/91 |
| 4,073,988 | 2/1978 | Nishida et al. | 428/91 |

FOREIGN PATENT DOCUMENTS 1248583 10/1971 United Kingdom .

1362806 8/1974 United Kingdom .

OTHER PUBLICATIONS

Translation of Japan Publication of Patent Application sho 45-711, published Jan. 10, 1970.

Translation of Japan Publication of Patent Application sho-46-37198, published Nov. 1, 1971.

Translation of Japanese Application Publication, 33,797, Published Oct. 30, 1970, Mitamura et al.

Translation of Japanese Application Publication, 54501 published Sep. 30, 1972, Fukuda.

*Primary Examiner*—Michael W. Ball

*Attorney, Agent, or Firm*—Austin R. Miller

[57] ABSTRACT

The composite sheet of this invention provides a fabric of superfine fibers impregnated with a high molecular weight elastic polymer and a hardened high molecular weight organic compound, having a nap on its surface formed from the ends of the fibers which constitute the fabric. The root portion of at least a part of the nap is bonded into a bundle by the high molecular weight organic compound, and the tip portion of the nap constituting the bundle is fibrous, thereby including at least some individually distinct fibers.

The composite sheet or fabric has the appearance of a high-quality napped woolen woven fabric, deep in color, having a smooth touch, having bulkiness, water-washability and easy care due to excellent crease resistance and packability. It is especially suitable for clothing.

24 Claims, 11 Drawing Figures

COMPOSITE NAP SHEET AND PROCESS FOR PREPARING THE SAME

BACKGROUND OF THE INVENTION

This application is a continuation of Ser. No. 907,118 filed May 18, 1978, now abandoned and a continuation-in-part of Application Ser. No. 830,426, filed Sept. 6, 1977, now abandoned. The present invention relates to a composite sheet material having an appearance like that of a high-quality napped woolen woven fabric, particularly suitable for clothing and the like.

The clothing industry has long desired a fabric having an appearance like that of a high-quality napped woolen woven fabric, having softness, pliability and a soft touch, and having an upright nap which is resistant to bending down and is relatively erect as compared with the nap of suede. The clothing industry has also desired a product having a deep color appearance together with smoothness, luster and good resistance to cigarette burns, free from the selvage fraying that occurs in woven fabrics, and light weight and crease resistance.

In the prior art, napped fabrics impregnated with elastic polymers have an appearance like suede, and not like napped woolen woven fabrics.

PRIOR ART

Laid-open Japanese Patent Application No. 401/1974 describes the application of a specified cationic active agent to a non-woven fabric having a nap consisting of superfine fibers and containing an elastic polymer which binds the root portion of the nap. This disclosure seeks an improvement of the nap. However, the resulting fabric is always suede-like, and never looks like a napped woolen woven fabric.

In laid-open Japanese Patent Application No. 54501/1974 there is described a process for preparing artificial leather which includes the steps of impregnating the non-woven fabric with a binding substance prior to impregnation and coagulation of the non-woven fabric with an elastic polymer. The impregnant is silicone together with a water-soluble high molecular weight substance, such as polyvinyl alcohol. The procedure then involves buffing the impregnated non-woven fabric and thereafter removing the binding substance. The object of using silicone is to prevent the bonding of the fibers with the elastic polymer, utilizing the sliding effect of silicone and raising a uniform and short nap at the time of buffing. This process is entirely different from binding the nap, as accomplished by the present invention, as will appear in further detail hereinafter. Moreover, in the present invention, it is necessary that the high molecular weight organic compound should be hardened.

Japanese Patent Application Publication No. 33797/1970 describes a process for preparing artificial leather by impregnating a preliminarily silicone resin processed fabric with an elastic polymer and coagulating the fabric. The object of using a silicone resin is the same as in the Laid-open Japanese Patent Application No. 54501/1972, which weakens the adhesive strength of the fiber to the elastic polymer.

Laid-open Japanese patent application No. 4460/1972 describes a method of achieving an objective similar to that of the above described Japanese application Publication No. 33797/1970. It uses wax instead of silicone.

The above-described prior art publications do not suggest preparing a fabric having an appearance like that of a high-quality napped woolen woven fabric by binding a multiplicity of naps to a single unitary strand with a hardened organic high molecular weight compound.

OBJECTS OF THE INVENTION

An object of the present invention is to provide a novel fabric having the appearance of a high-quality napped woolen woven fabric suitable for clothing, wall coverings, furniture and the like.

In particular, it is an object of the present invention to provide a novel material which is remarkable in that it may be synthetically prepared, that it has a nice surface touch, that it has an appearance like that of a high-quality napped woolen woven fabric, that it has no selvage fray like a woven fabric, that it can be sewn without a hemstitch, that it is resistant to cigarette burns, that it has a smooth touch and a bulkiness and puffy feeling to the touch, and that it does not make harsh sounds like those of leather.

Further objects are to provide a fabric which has little nap reversibility like that of suede, is light weight and has a stable appearance and dimension after washing.

It is a particularly important object of this invention to provide a fabric which can be washed with water, which has a nap that does not tend to become entangled, that is durable; and that possesses easy-care properties and crease resistance such that when it is folded and put into a bag and thereafter taken out, it is immediately ready to wear.

SUMMARY OF THE INVENTION

This invention relates to a composite sheet including a fabric impregnated with an elastic polymer and a hardened high molecular weight organic compound, having a surface nap formed from the ends of fibers constituting the fabric, each of the naps being a bundle of fibers having a root portion and a tip portion. The root portion in a majority of the naps has the shape of a single unitary strand and the tip portion having at least some individually distinct fibers.

This invention also relates to a process for preparing such a composite sheet, which process includes the steps of imparting a hardenable organic high molecular weight compound to a fabric, hardening said compound, subsequently applying an elastic polymer to said fabric, and thereafter buffing and/or raising said fabric nap.

BRIEF DESCRIPTION OF THE DRAWINGS

FIG. 2(A) shows the partially separated naps even at the root portion. FIG. 2(B) shows completely bound naps at the root portion. Both have slender or branched ends.

DETAILED DESCRIPTION OF THE INVENTION

The fabric of the present invention includes a bundle of superfine fibers less than about 0.7 denier, and preferably less than about 0.5 denier. Various processes may be used for obtaining a bundle of superfine fibers. However, in the practice of the present invention, a multi-component fiber may be used. One such fiber is described in, for example, U.S. Pat. No. 3,531,368. Such fibers are commonly called "islands-in-a-sea" type fibers, and are most preferable for many reasons. They are easy to prepare, can be obtained in high yield, have excellent dispersibility and qualitative stability, reproducibility, and constitute an easily controllable structure which is easy to needle-punch or otherwise form into intertwined configurations.

Figures 5A, 5B, 5C, 5D, 5E, 5F:
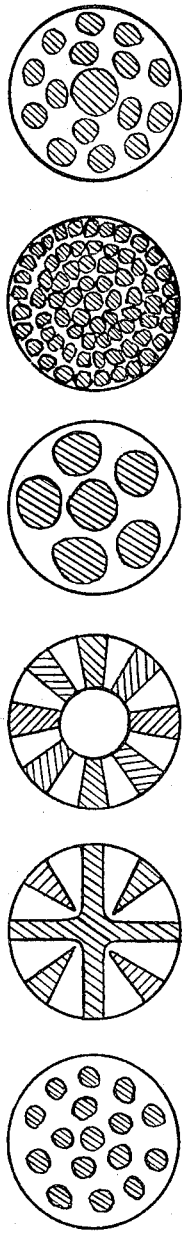
FIGS. 5(A) to 5(F) are cross-sectional views of fibers which may be utilized for preparing superfine fibers for use in the practice of this invention.

Multi-component fibers are such that when at least one component, i.e., the sea component, is chemically or mechanically removed therefrom, superfine fibers remain as a bundle. These comprise the remaining fiber components, i.e., the island components. By way of example, typical cross sections of such fibers are shown in FIGS. 5(A), 5(D) and 5(F) of the drawings. When cross sections of such "islands-in-a-sea" type fibers are observed, many island components are divided so as to be dispersed and distributed in the sea component and the island components are continuous in the direction of the fiber axis. Any number, designated as "n", of island components may be utilized. However, "n" is usually less than about 10,000.

The island components of such multi-component fibers can be polyesters such as polyethylene terephthalate or copolymers thereof (a homopolymer or copolymer for mixing like isophthalic acid and sodium sulfonate isophthalate) or polybutylene terephthalate, polyamide 6, 66 or 6–10; polypropylene, polyethylene or polyacrylonitrile, for example.

Such "islands-in-a-sea" type fibers are not limited in shape. Further, they may be solid or hollow, or may have transformed cross sections.

Many studies of fibers similar thereto have been carried out. For example, a polymer blend spun fiber is obtained by selecting the characteristics of the polymers, their blending conditions and their spinning conditions so that one component is continuously disposed along the length of another component. The fibers of the bundle are bound by a binding agent of a yarn spun by a method of spinning which comprises passing two kinds of polymer through a labyrinthian mixer (vibmixer, static mixer, etc.) to promote division and integration of the two kinds of polymer. Thereafter, these polymers are passed through a filter to change their film-state configuration to a dot-like configuration, followed by spinning, especially superdraw spinning and drawing, or by superfine wet spinning. The multi-component fiber becomes a bundle of superfine fibers or fibrillated by dynamically strong rubbing. Fibers exhibiting characteristics similar to those of the multi-component fibers, for example, are illustrated in FIGS. 5(B) and 5(C) of the drawings. Using these fibers, fabrics may be prepared.

The specific nature of the fabric of the present invention is not particularly limited, in that it may be woven, knitted or may even be a non-woven fabric. Especially in the case where the fabric is a non-woven fabric, it is possible for it to have an appearance like that of a napped woolen woven fabric, despite the fact that it is a non-woven fabric. Therefore, the effects obtainable by the practice of the present invention appear remarkable. A very typical non-woven fabric is that obtained by needle-punching a laminated web or monolayer web with a cross lapper and a random webber. It is especially preferable to slice and halve the fabric later and to combine the buffing.

When the resulting fabric is made of "islands-in-a-sea" type multi-component fibers, it is necessary to remove or separate the sea component except when the ratio of the sea component to the island components is small. It is necessary to remove or separate the sea component (if this is to be done) before the hardenable organic high molecular weight compound is applied to the fabric. When the sea component is removed or separated, the fabric becomes soft. However, when the overall fiber density is low, the fabric sometimes becomes too soft, especially after postprocessing handling. In such a case, it is preferable in advance to apply to the fabric a water-soluble or hot water-soluble sizing agent, such as polyvinyl alcohol, a partly saponified polyvinyl alcohol, carboxymethyl cellulose, methyl cellulose, sodium polyacrylate, polyacrylamide or starch, for example, in accordance with the present invention. This step may be accomplished by conventional means such as dipping, coating, squeezing and drying, for example. The sizing agent is removed when necessary for fixing the shape of the fabric. The agent is normally removed after the elastic polymer has been applied. However, it may be removed prior thereto, if desired. If the sea component of the "islands-in-a-sea" type multi-component fiber is polystyrene or a copolymer of polystyrene and another known monomer of the vinyl series, various solvents may be used for removal of the sea component, such as trichloroethylene, perchloroethylene, toluene, xylene or benzene, either alone or in combinations of two or more.

The material applied to the resulting fabric is a hardenable organic high molecular weight compound. After application, it is hardened. Such hardenable organic high molecular weight compounds include the organosilicone compounds (in solution or as emulsions), self-crosslinking type acryl resin emulsions. The most effective compound for most purposes according to the present invention is the high molecular weight organosilicone compound.

A typical example of a procedure for forming a hardened high molecular weight organosilicone compound results from combining a polyorganosiloxane with a chemical necessary for hardening. This may be called vulcanization in the case of a rubber, which is included herein. Especially useful in the practice of the present invention is silicone rubber.

It is known that such silicone rubber may be prepared by various reactions. There are, for example, a monoliquid type and a biliquid type silicone rubber for each of which various reactions are applicable. These include the condensation reaction type, the addition reaction type and the ring-opening reactions. When chemical formulae of the main reactions only are shown, they are as follows. In many cases, the reactions occur at a relatively low temperature such as room temperature. In others, the reacting may be in the presence of moisture. In others, a high temperature may be used.

The following reactions apply to the monoliquid group:

(1) Acetic acid-removing condensation type:

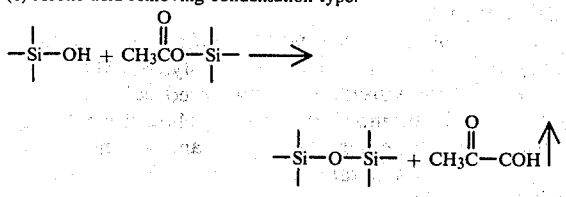

(2) Oxime-removing condensation type:

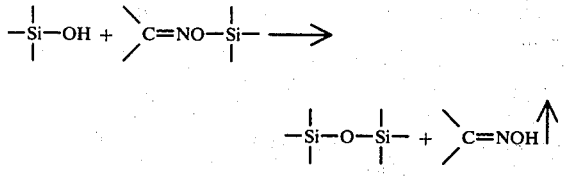

(3) Alcohol-removing condensation type:

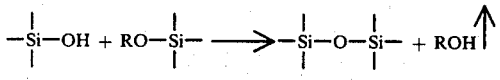

(4) Amine-removing condensation type:

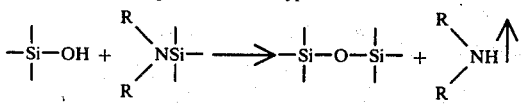

(5) Amide-removing condensation type:

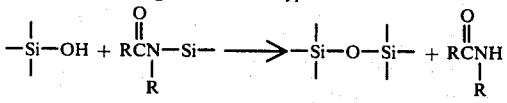

Monoliquid addition reaction type:

(1) Vinyl-addition reaction type:

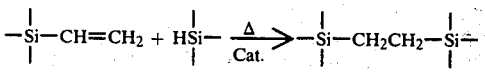

(2) Peroxide type:

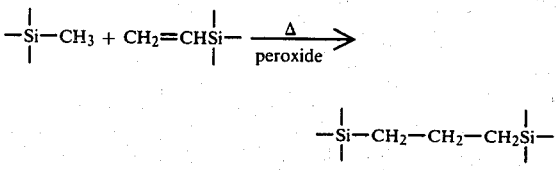

Biliquid condensation reaction type:

(1) Alcohol-removing condensation type:

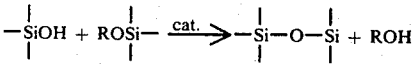

Example of Cat.: metal salt of fatty acid (2) Oxylamine-removing condensation type:

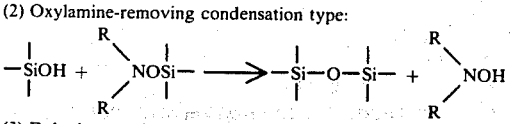

(3) Dehydrogenation condensation type:

-continued

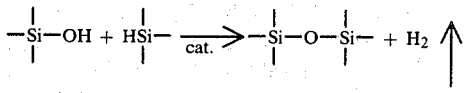

Biliquid reaction type:

(1) Vinyl-addition reaction type:

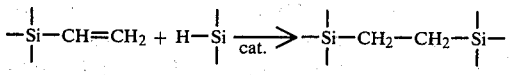

Example of Cat.: platinum compound, etc.

(2) Ring-opening reaction type:

(a)

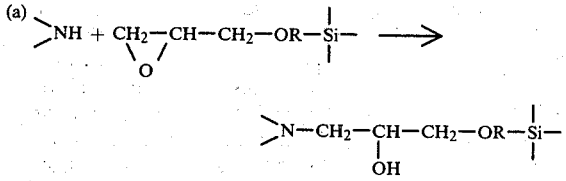

(b)

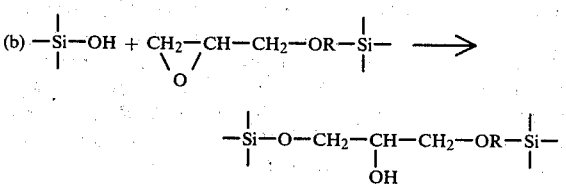

In the aforesaid reactions, the following agents are preferably used as catalysts: $(C_4H_9)_2Sn(OCOCH_3)_2$; $(C_4H_9)_2Sn(OCOC_7H_{15})_2$; $(C_4H_9)_2Sn(OCOC_{11}H_{23})_2$; $Zn(OCOC_7H_{15})_2$; $N(CH_2CH_2OH)_3$; and $H_2PtCl_6$.

The main skeleton is polysiloxane, and polydimethyl siloxane is most representative, besides which a little or considerable part of which is of the phenyl group, hydrogen, or of the vinyl group for crosslinking reactivity or of the epoxy group, the ring-opening reactivity of which is well understood. Compounds having terminal

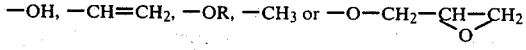

are generally used. These terminal groups react between or among themselves or with various silanes. In the reaction, water (including water vapor) may be present. A platinum compound such as chloroplatinic acid may be used. Other compounds include peroxide, organometallic compounds such as a metal salt of a fatty acid, for example, a radical-releasing compound and an aminosilane compound, all in conformity with the reaction selected.

The molecular weight of the main skeleton of the silicone is about 10,000 to 1,000,000 in the typical case.

For improving the physical properties of a hardened (organic high molecular weight) compound, silicon oxides such as aerosol silica may be used. Titanium oxide, carbon black, calcium carbonate, diatomaceous earth, quartz powder, asbestos, zinc oxide or zirconium silicate may also be used. They are preferably treated with chain or cyclic silane, silanol, siloxane or silazane. Besides these, various additives such as coloring pigments, or extracting agents for making the fiber porous, may also be used.

The properties and characteristics of these chemicals are well known, as evidenced by the many patents owned by Dow Corning Co., of the U.S.A., the technical papers of Toray Silicone Co., Toshiba Silicone Co. and Shinetsu Chemical Industries, Co., all of Japan.

Recent applicable literature includes Japanese Patent Application Publications Nos. 27704/1976, 27705/1976 and 27707/1976 (Dow Corning Co.), Laid-open Japanese Patent Application NO. 94295/1975 (Dow Chemical Co. of Great Britain), Japanese patent application Publication No. 27703/1976 (Kuraray Co. of Japan), Japanese patent application Publication No. 24303/1976 (Toshiba Silicone Co.), Japanese Patent Application Publications Nos. 24301/1976, 24302/1976, 23977/1976, 23979/1976, 25069/1976, 28308/1976, 28309/1976 and 28310/1976 (Shinetsu Chemical Industries Co.), as well as Laid-open Japanese patent applications Nos. 34291/1976, 39773/1976 and 49995/1976 (Shinetsu Chemical Industries Co.), in which resinification of various objects is disclosed. This knowledge and art is effectively and preferably used in the present invention.

In an important step of the present invention, a hardenable high molecular weight organic compound, such as an organosilicone compound, is applied to the fabric. Impregnation may be used. The compound has a viscosity at which it is easy to impregnate the fabric in an unreacted condition in many cases. Therefore, it is possible to apply the organic compound directly or to impregnate the fabric with it. However, it is preferable to make the compound into a solution or emulsion (dispersion). In this case it is not only easy to apply or to impregnate, but also excellent uniformity, controllability of the quantity applied and operability are achieved. The solvent and the dispersion medium are removed later by drying. The hardened high molecular weight compound is relatively inelastic.

Subsequently, after application or impregnation a hardening reaction of the hardenable organic high molecular weight compound has taken place, fixation of emulsion particles is caused. Alternatively, the reaction and the fixation are caused to proceed simultaneously. For exaple, when hardening is effected by heating, the sheet of fabric is passed through a heating zone. When the hardening reaction is to proceed by moisture, the fabric sheet is allowed to stand in humid air for a sufficient period of time to harden the compound. The application of the compound to the fabric is generally carried out in air.

As mentioned above, when a sizing agent is used for an intertwined sheet, it is necessary to effect heating so as not to cause the agent to become insoluble or to melt the fibers per se.

According to this invention the silicone organic compound hardens, fixes and adheres in a space among bundles of fibers. As a result of surface tension, the silicone compound tends to adhere to the inside and around the bundles of fibers and to the points of intersection of the bundles of fibers. In order further to promote this tendency, it is preferable to use a silane coupling agent in advance, and in admixture, for reasons to be mentioned in further detail hereinafter.

Next, an elastic polymer such as polyurethane is imparted to the fabric. The elastic polymer is preferably used as a solution or emulsion. When the silicone is silicone rubber, there is a two-stage impregnation of two specified elastomers. After coagulation and fixation (solidification), the removal of the sizing agent is caused to proceed by washing, if necessary. When a solvent is used, it is preferable that a greater part or substantially all of the solvent used to removed together with the sizing agent.

As examples of elastic polymers that can be used are polyurethanes of the ether series, polyurethanes of the ester series (polyurethane is considered as including an urea bond, including block- and co-polyurethane), polyurethane of the ether ester series, and all the various rubbers such as natural rubber, chloroprene rubber, SBR and NBR, for example. Those elastic polymers which withstand the applicable dyeing temperatures are preferable. The elastic polymer is preferably more elastic than the relatively inelastic hardened high molecular weight polymer.

One example of the most preferable combination in preparation of a composite sheet of the present invention includes polyester as the fiber, partly or completely saponified polyvinyl as the sizing agent, a material of a silicone rubber-forming reaction as the hardenable high molecular weight organic compound, and polyurethane as the elastic polymer.

Polyurethane is most often prepared from a reaction of a polyol with a diisocyanate. Useful polyols include polytetrahydrofuran, polycaprolactone or polyhexanediol adipate, which may be used alone or in admixture. Useful isocyanates include diphenylmethane-4,4'-diisocyanate (MDI) and hydrogenated MDI which may be used alone, in admixture or in a multi-stage reaction. Suitable chain extenders include ethylene glycol, butylene glycol, hydrazine and methylene bis-aniline (MBA), which may be used alone, in admixture or in a multi-stage reaction.

The so-completed composite sheet is thereafter buffed. As occasion demands, it is sliced, buffed and napped. Sometimes it is buffed after other treatments are carried out. A napped grey fabric when not spun dyed, is commonly subsequently dyed. The sheet can be dyed with basic dyes when it is modified in properties to be dyeable with a basic dye. Nylon, such as nylon 6 or nylon 66, is conventionally dyed with an acid dye.

After the composite sheet is dyed, it is preferable to carry out reduction washing.

A commonly known finishing agent is usually applied to the sheet after it is dyed. A finishing agent is sometimes not used, in order further to improve the shine, luster, touch and softness of the fabric. However, it is preferable to use a finishing agent.

After dyeing, and upon drying the fabric, it is preferable to wet comb, (smooth down with a brush) the nap in the direction of, or in a direction counter to the direction in which the fabric passes through the dyeing machine, and/or the direction of buffing.

Figure 1:
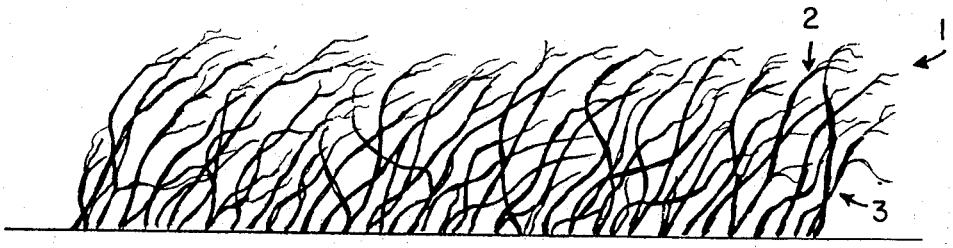
FIG. 1 is a side view showing one embodiment of the nap of a composite sheet according to the present invention.
Figure 2A:
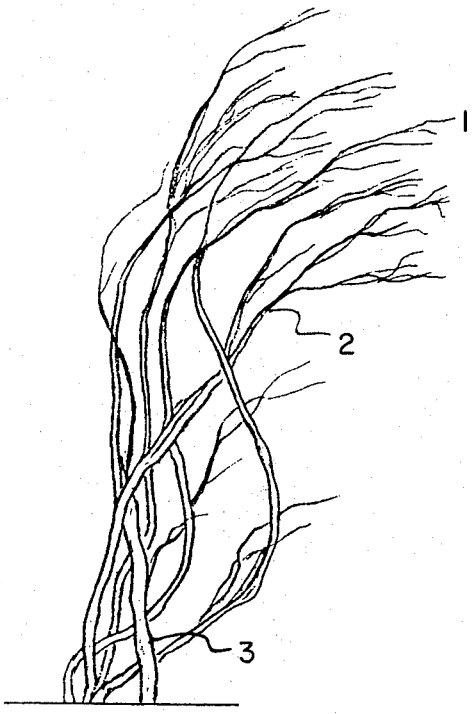
FIGS. 2(A) and 2(B) are partial enlarged views of FIG. 1.
Figure 2B:
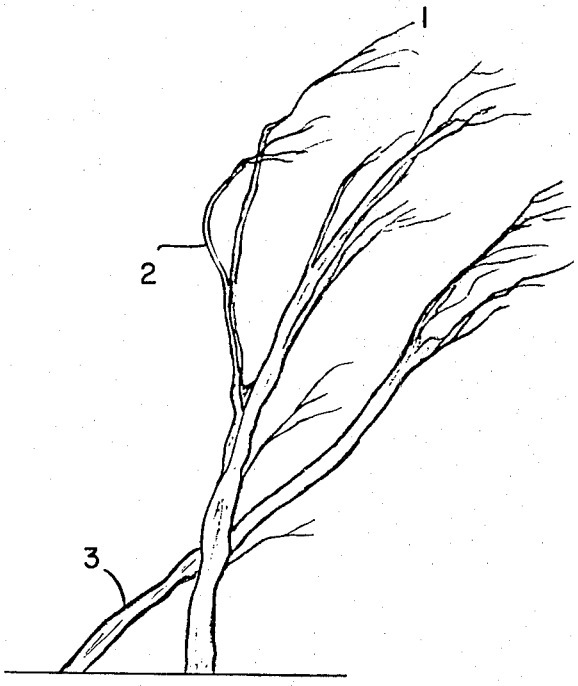

Referring to FIG. 1, an example of the nap according to this invention will be observed. The novel material has an appearance like that of a high-quality napped woolen woven fabric. This nap is different from that of conventional materials prepared for making a suede-like fabric. In this example, the nap is bound as bundles with hardened silicone. In some bundles the number of fibers halfway up the strand decreases, and the bundles are tapered as a result of buffing. In FIG. 1, the tips of the superfine fibers are designated by the number 1. Portions where fibers are bound, but decrease in number to becoming slender bundles are designated by the number 2, and portions of superfine fibers, as bound together, are designated by the number 3.

Figure 3:
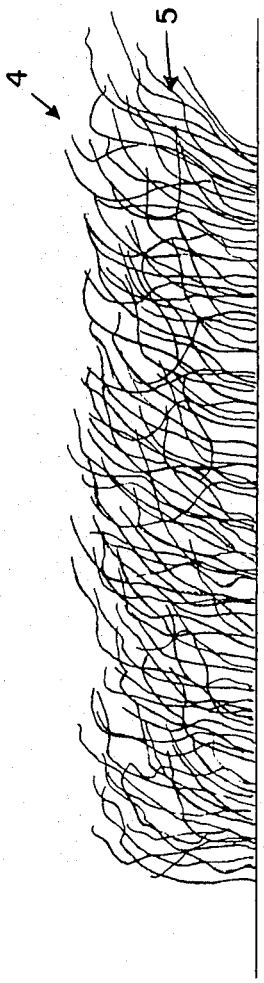
FIG. 3 PRIOR ART
FIG. 3 is a side view showing the appearance of the nap of a conventional suede-like sheet.

On the other hand, as a comparison for reference, an example wherein a silicone compound is not used, but wherein polyurethane only is used, is subsequently shown. In this case also, the fabric is like suede. However, the nap configuration in the fabric becomes like FIG. 3, for example. Referring to FIG. 3, portions close to the tips of the naps are designated 4, and root portions of the naps are designated 5. These are quite slender; ordinarily, this fabric has a suede-like character, and the nap usually lies over in a more fallen or bent configuration.

In a composite sheet or fabric of the present invention, the root portion of the nap is bound and thick, while the tip becomes slender or branches and becomes quite slender, and has a nice touch and feel. The main structure is a bundle of fibers obtained by removing or mechanically peeling the sea component from an "islands-in-a-sea" type multi-component fiber. However, as the case may be, thicker bundles can each comprise several bundles of fibers by needle punching the fibers to form the fabric. The root portion being thick, the nap becomes firm. Therefore, as compared to fibers that are not bound, namely, the suede-like fabrics, the fabric of the present invention does not have a reversibly falling nap, and is free from the suede effect, which is considered to be one reason why a napped woolen woven fabric-like appearance is thereby given. Tapering is brought about in using bundles of originally slender fibers, by the fact that tip portions are abraded off during buffing, and by the fact that the unitary bundles are divided. On the other hand, an elastic polymer, such as polyurethane, is naturally located around hardened silicone which first occupies a place around the fibers. When adhesion of the elastomer to the hardened silicone is poor, the elastic polymer such as polyurethane tends to be stripped off and removed at the time of buffing. If the bonding of the fibers with the silicone is weak, the composite sheet become suede-like because hardened silicone is removed at the time of buffing and the nap is formed only of fibers which are not bound to the silicone.

In the present invention, it is preferable that the bond strength between the bundle of superfine fibers and the hardened high molecular weight organic compound be greater than that between the hardened high molecular weight organic compound and the elastic polymer.

The bonding strength between the bundle of superfine fibers and the hardened high molecular weight organic compound may be such that after buffing and/or raising, more preferably after dyeing, the adherence of the hardened high molecular weight organic compound to the bundle of superfine fibers can be observed and recognized under a microscope.

The following conditions are preferable, assuming A and B are defined as:

(A) the adherence between the fiber and hardened silicone (B) the adherence between the hardened silicone and the elastic polymer.

It can be observed from the nap of a composite sheet of the present invention that it is preferable that A be sufficiently high in adherence and affinity, and from the viewpoint of the feel and the touch of the fabric it is preferable that B be sufficiently low in adherence and affinity. The balance between A and B is important, and when A is increased, B should also increase. In such a case less nap will fall out of the sheet due to low adherence.

From such a point of view, it is preferable that the bundles of fibers be treated with a silane coupling agent, such as by adding the silane coupling agent to them before they are spun. Various silane compounds, especially silane coupling agents ordinarily used for treating aerosol silica and diatomaceous earth with silane, are used for improving the adherence to silicone resins and other high molecular weight substances. However, the opposite case of treating the fibers with a silane coupling agent, in advance, is carried out for the first time by the present invention. At this time, it is possible to add a silane coupling agent to the bundles of fibers upon spinning the fibers so as to provide good adherence to the hardened silicone.

In a similar way, it is preferable to add a silane coupling agent to the silicone to be hardened or to use an added hardenable type of resin which plays the role of a silane coupling agent for the hardening reaction. Thus, it is preferable to have the excellent physical properties and adhesive strength of the fibers of hardened silicone as required in A.

Examples of silane coupling agents for polyester fibers are as follows:

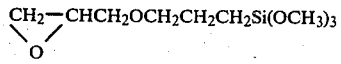

d. $CH_2{=}CHSi(OOCCH_3)_3$ e. $(CH_3O)_3Si(CH_2)_3NHCH_2CH_2NH_2$ f. $HSCH_2CH_2CH_2Si(OCH_3)_3$ g. $NH_2CH_2CH_2CH_2Si(OCH_2CH_3)_3$

Besides these compounds, other silane coupling agents on the market can be used in this invention.

For example, silane coupling agent "c" as set forth above, is excellent for use with polyamide fibers, either together with a reaction promoter or alone.

As mentioned in the case where bundles of superfine fibers and hardenable silicone are caused to bond strongly, it is necessary to provide a low ratio of the hardenable silicone to the other later applied elastic polymer.

Furthermore, as regards relationship B, it is better not to have strong adherence from the viewpoint of feel and touch. However, from the viewpoint of preventing nap from falling out, the adherence must not be too poor. Typically, adherence tends to be poor between hardenable silicone and another high molecular weight elastomer. However, in order to reduce it, it is preferable to add in advance a chemical which enhances mold-release and sliding qualities, such as a polyorganosiloxane or a fluorine compound which is not of a hardenable type, but of a mold-releasing type. Upon using the silane coupling agent, care should be taken not to increase adherence of the hardenable silicone to the elastic polymer. When, for example, a silane coupling agent is mixed with a hardenable silicone and used with a polyester fiber, care is necessary upon selecting such agent so that, even if it is possible to make the adhesive strength of such agent to polyester high, when the high molecular weight elastomer is polyurethane; the agent does not adhere too strongly to such polyurethane. When measures are taken to initiate the reaction, it is preferable to treat the sheet as a whole with various fiber treating agents enhancing ease of mold-release and sliding, such as silicon or paraffin, after completing the treatment of the sheet with hardenable silicone. This enhances the feel of the product after subsequent treatment with the elastic polymer. It also simplifies buffing.

Where emphasis is placed to some extent on inhibiting the nap from falling out, at a sacrifice of the feel of the fabric, it is preferable to raise the bonding strength of the fiber with silicone. For example, in order to prevent the nap from falling out after dyeing it is preferable to treat the product with a self-crosslinking acryl emulsion and a silicone rubber (resin)-forming liquid or emulsion thereof, examples of which will appear hereinafter.

If such treatment for preventing nap from falling out becomes excessive, it tends to harm the feel and touch of the nap. It is possible to control such treatment by changing the extent of the treatment according to one's desire, for example, by changing concentration at the time of the treatment.

Figure 4:
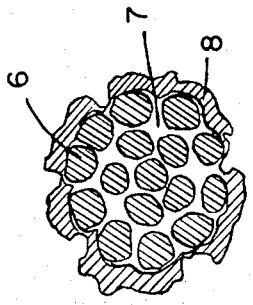
FIG. 4 is a cross-sectional view of a bundle of fibers of the present invention.

The relation of bundles of fibers with two kinds of high molecular weight compounds, is the essence of the structure of the composite sheet in FIG. 4, wherein fibers are designated as 6, hardened silicone is designated as 7 and polyurethane is designated as 8. The polyurethane 8 surrounds the hardened silicone 7 partly or entirely. Accordingly, what is shown in the cross-sectional view of FIG. 4 is similarly formed in all or a considerable part of an intertwined sheet and of a napped portion thereof. Parts which become nap by buffing consist of fiber 6 and hardened silicone at the time of buffing. On the other hand, the base portion of the fabric remains almost unchanged after buffing. The polyurethane is not removed. The fiber 6 and hardened silicone 7 are held at the roots, but at the tips the hardened silicone 7 comes off, or parts of fiber 6 and hardened silicone 7 are simultaneously scraped off, with the remaining bundle becoming slender or separate, and taking on a tapered configuration toward the tip. Because the nap assumes a configuration and content like this, the fabric according to the present invention has an appearance like that of a high-quality woolen woven fabric.

As regards the amounts of the hardened organic high molecular weight compound and the elastic polymer to be applied to the fabric, it is preferable that the total of the two be about 15 to 70 parts by weight based on 100 parts by weight of the composite sheet. The ratio of the hardened organic high molecular weight compound to the elastic polymer to be applied to the sheet is about 0.5 to 30 parts by weight, and preferably about 0.5 to 20 parts by weight of the former, to 100 parts by weight of the latter.

Fabrics according to the present invention are useful in clothing such as coats, blazers, sport shirts, hats, furniture such as for upholstery and bed covers, wall materials, carpeting, ornaments, shoes, boots, handiwork materials and pouches such as bags, for example.

Hereinafter, the present invention will be described by reference to specific examples. However, these examples are intended to be illustrative and are not intended to define or to limit the scope of the present invention, which is defined in the appended claims.

EXAMPLE 1

Using cut fibers of an "islands-in-a-sea" type fiber whose, cross section was like that shown in FIG. 4, and whose sea component was a blend of polystyrene 47.5/polyethylene glycol 2.5 and whose island component was polyethylene terephthalate. The fiber further has a sea/islands ratio of 50/50, 16 islands, a denier of the "islands-in-a-sea" type fiber of 3.2 d, a number of crimps of 13 mounts/inch and a cut length of about 51 mm. A web was formed by the cross lapper method, which was needle punched at 3300 punches/$cm^2$ to obtain an intertwined non-woven fabric having a weight per unit area of 500 g/$m^2$ and an apparent density of 0.19 g/$cm^3$. When this non-woven fabric was further contracted in hot water, at 97° to 100° C. its weight per unit area became 833 g/$m^2$ and its apparent density became 0.379 g/$cm^3$ in the dry state. One hundred parts of this non-woven fabric, of the "islands-in-a-sea" type fiber, was impregnated with about 40 parts, calculated as solid, of a solution of polyvinyl alcohol whose degree of saponification was about 80%, dried and using trichloroethylene, 99.2% of the sea component was removed.

This non-woven fabric from which almost all of the sea component had been removed was impregnated with about 250% in wet weight of a silicone treated liquid prepared by dissolving in advance 30 parts by weight of a composition containing:

(a) 95 parts by weight of polydimethylsiloxane having terminal —OH groups and a molecular weight of about 25,000 (25° C., 3000 CS); and (b) 5 parts by weight of partly condensed $CH_3Si(OCH_3)_2$ in 967 parts of trichloroethylene, next while stirring the resultant solution, adding 3 parts by weight of $(CH_3O)_3Si(CH_2)_3NHCH_2CH_2NH_2$* thereto.

*This compound usually includes ethylenediamine etc. in very small quantities as impurities.

At about 70° C., the greater part of the trichloroethylene was scattered off and the impregnated non-woven fabric was allowed to stand in the air at a room temperature of 12° C. in a relative humidity of 60% for 24 hours to complete the hardening of the silicone. The adhered amount of silicone was 7.9% calculated as solid and the adhered amount of silicone per unit area was 59.3 g/$m^2$.

This non-woven fabric was further impregnated with a dimethyl formamide solution of polyurethane so that the adhered amount of polyurethane calculated as a solid became about 60 parts based on 100 parts of the island components, coagulated in a water bath and polyvinyl alcohol removed. The fabric was then sliced into two non-woven fabrics of equal thickness each of which was buffed on the non-sliced surface of the nap. Each was then made into a non-woven fabric having a napped surface and dyed under pressure with a dispersed dye at 125° C.

This product looked like a woolen woven fabric, having a puffy appearance, and at the same time, having a soft pliant feel, sharply different from the conventional material and artificial suede products.

A comparison of a product according to the present invention and another product prepared without any silicone-treating step will be shown in Table 1.

TABLE 1

| Characteristics of the product of Example 1 | | | |
|---|---|---|---|
| | | Product | |
| Characteristics | | A product according to the present invention | A comparative product obtained without passing through a silicone treatment |
| Overall appearance | | Deep in color, like that of a puffy woolen woven fabric | Like that of leather suede |
| Feel | | Soft and Puffy | Like that of leather suede |
| Nap | | Hardly having directionality, consisting mainly of nap as shown in FIG. 1 | Having directionality, consisting of nap as shown in FIG. 3 |
| Sewing properties | | Like those of a napped woolen woven fabric | Like those of leather suede |
| Melt resistance (1)* (Time until a hole was opened by a cigarette burn | | About 10 seconds (about 3 times that of the comparative product) | About 3 seconds |
| Tear strength (kg) | L.* | 2.02 | 0.68 |
| | B.* | 2.81 | 0.59 |
| Tensile strength ($kg/cm^2$) | L.* | 55.4 | 74.8 |
| | B.* | 56.3 | 65.2 |
| Tensile elongation (%) | L.* | 90 | 74 |
| | B.* | 116 | 107 |
| Brush abrasion strength index (2)* | 164 | 100 | |
| Light resistance (fade-o-meter, 20 hrs.) (3)* | | Above Grade 5 | Grade 5 |
| Washing fastness (discoloration fading) | | Grade 5 | Grade 5 |
| Dry cleaning (discoloration, fading) | | Grade 5 | Grade 5 |

Note:
(1)* Time since cigarette was lit until a hole was made on the sample by the self-weight of the cigarette.
(2)* Frequency of revolution of a round nylon brush until a hold began to be made thereby, shown by an index based on that of a comparative compound which was made 100.
(3)* Grade 5 ← → Grade 1
Hardly discolered of faded Very discolored
L.* Length
B.* Breadth

EXAMPLE 2

The same fiber as in Example 1 was treated the same as in Example 1 to prepare a non-woven fabric of an "islands-in-a-sea" type fiber, from which the sea component was removed. The obtained non-woven fabric was impregnated with about 250% in wet weight of a silicone treating liquid prepared by dissolving in advance, 80 parts by weight of a composition containing:

(a) 95 parts by weight of polydimethylsiloxane having a terminal of —OH and a molecular weight of about 25,000 (25° C., 3000 CS); and (b) 5 parts by weight of partly condensed $CH_3Si(OCH_3)_3$ in 912 parts by weight of trichloroethylene, then while stirring the resultant solution, adding 8 parts by weight of $(CH_3O)_3Si(CH_2)_3NHCH_2CH_2NH_2$* thereto.

After removing the greater part of the trichloroethylene at about 70° C., the impregnated non-woven fabric was allowed to stand in the air at a room temperature of 25° C. and a relative humidity of 60% for 48 hours to complete the hardening of silicone. The adhered amount of silicone calculated as solid was 19.3% and the adhered amount of silicone per unit area was 142.5 $g/m^2$ at this time.

This non-woven fabric was further impregnated with a dimethyl formamide solution of polyurethane containing a black pigment, i.e., about 8% of a carbon black preparation based on the solid component of polyurethane, so that the adhered amount of polyurethane calculated as solid might become about 60 parts based on 100 parts of the island components. Thereafter, the fabric was processed according to Example 1.

The non-woven fabric was dyed a deep color using a dispersed dye under pressure and at a temperature of 125° C. Because the silicone did not contain carbon black, it was feared that the color of the product would become indistinct. However, the color of the product was unexpectedly deep, becoming a tint with an increased high-quality feeling. The other properties were about the same as those of Example 1.

The characteristics of a product obtained in accordance with the present invention will be shown in Table 2.

TABLE 2

| Characteristics of the product of Example 2 (concerning the characteristics of a comparative product, refer to Table 1) | |
|---|---|
| | Product |
| Characteristics | A product according to the present invention |
| Overall appearance | Deep in color, a puffy appearance like that of a woolen woven fabric |
| Feel | Soft and pliant |
| Nap | Having no directionality, consist- |

TABLE 2-continued

| Characteristics of the product of Example 2 (concerning the characteristics of a comparative product, refer to Table 1) | | |
|---|---|---|
| Characteristics | | Product A product according to the present invention |
| | | ing mainly of nap as shown in FIG. 1 |
| Sewing properties | | Like those of a woolen woven fabric |
| Melt resistance (time until a hole was opened by a cigarette burn | | About 12 seconds |
| Tear strength (kg) | L.* | 1.43 |
| | B.* | 1.70 |
| Tensile strength ($kg/cm^2$) | L.* | 41.8 |
| | B.* | 51.0 |
| Tensile elongation (%) | L.* | 65 |
| | B.* | 89 |
| Schiefer abrasion strength index | | 108 |
| Light resistance (fade-o-meter, 20 hrs.) | | Grade 5 |
| Washing fastness (discoloration, fading) | | Grade 5 |
| Dry cleaning (discoloration, fading) | | Grade 5 |

NOTE:
L.* Length;
B.* Breadth
The testing methods were according to those of Example 1.

EXAMPLE 3

The same fiber as in Example 1 was used in preparing a non-woven fabric of an "islands-in-a-sea" type fiber. From the fiber, the sea component was removed and the fabric was treated with a reaction type silicone in the same manner as in Example 1. Next, the non-woven fabric was further impregnated with a dimethyl formamide solution of polyurethane containing a black pigment, i.e., about 8% of a carbon black preparation based on the solid component of polyurethane, so that the adhered amount of polyurethane would become about 60 parts in solid based on 100 parts of the island components. Thereafter, the fabric was processed according to Example 1.

The non-woven fabric was dyed in a deep color dispersed dye under pressure and at a temperature of 125° C. As in Example 1, the color of the product was deep, and the napped product increased in a high-quality feeling and in tint, and having an appearance like that of a woolen woven fabric.

EXAMPLE 4

The same fiber as in Example 1 was used in preparing a non-woven fabric of an "islands-in-a-sea" type fiber, from which the sea component was removed all in the same manner as in Example 1. The resultant non-woven fabric was impregnated with about 250% in wet weight of a silicone treating liquid which was reactive upon heating and prepared from the following components:

(a) 942 parts by weight of trichloroethylene (b) 50 parts by weight of the mixture:

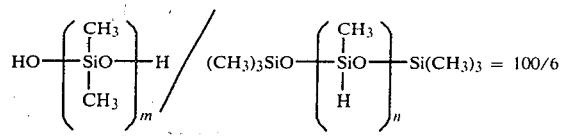

(m = 100 to 500, n = 10 to 40)

(c) 1 part of by weight of:

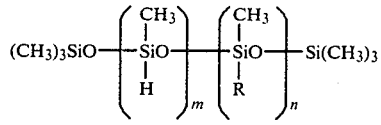

(m = 10 to 40, n = 10 to 40)
R = alkylstyrene (a = methylstyrene type)

(d) 7 parts by weight of: $(CH_3CH_2CH_2CH_2)_2Sn(OCOCH_3)_2$

Next, after the greater part of the trichloroethylene was removed at about 70° C., the fabric was heat-treated at 130° C. for 7 minutes. The adhered amount of silicone calculated as solid was 12.7% and the adhered amount of silicone per unit area was 95 $g/m^2$ at this time.

The non-woven fabric was further impregnated with a dimethyl formamide solution of polyurethane containing a black pigment, i.e., about 8% of a carbon black preparation based on the solid component of polyurethane, so that the adhered amount of polyurethane would become about 60 parts based on 100 parts of the island components.

Thereafter, the fabric was processed according to Example 1 and dyed to a deeper color. The dyed product had about the same appearance, properties and feel as those of Examples 1 to 3, although it was somewhat inferior in deepness of color as compared with those of Examples 1 to 3.

EXAMPLE 5

Using cut fibers of an "islands-in-a-sea" type fiber whose cross section is like that shown in FIG. 4, and whose sea component was polystyrene, whose island component was polyethylene terephthalate. The fiber further has a sea/island ratio of 43/57, number of islands of 16, denier of the "islands-in-a-sea" type fiber of 3.4 d, number of crimps of 13 months/inch and a cut length of 51 mm. A web was formed by a cross lapper method, which was needle punched at 3500 punches/$cm^2$ to obtain an intertwined non-woven fabric having a weight per unit area of 540 $g/m^2$ and an apparent density of 0.185 $g/cm^3$. When this non-woven fabric was further placed in hot water, at 97° to 100° C., its weight per unit area became 820 $g/m^2$ and its apparent density became 0.372 $g/cm^3$ in a dried state.

One hundred parts of this non-woven fabric, i.e., of the "islands-in-a-sea" type fiber, was impregnated with about 23 parts, calculated as solid, of a solution of polyvinyl alcohol whose degree of saponification was about 80%, dried and using trichloroethylene, 99.8% of the sea component was removed.

This non-woven fabric from which almost all of the sea component had been removed was impregnated with about 250% in wet weight of a silicone treating liquid prepared by dissolving in advance, 50 parts by weight of a composition containing:

(a) 95 parts by weight of partly condensed polydimethyl siloxane having a terminal of —OH and a molecular weight of about 25,000 (at 25° C. 300 CS), and (b) 5 parts by weight of partly condensed $CH_3Si(OCH_3)_3$ in 945 parts by weight of trichloroethylene, then while stirring the resultant solution, adding 5 parts by weight of $(CH_3O)_3NHCH_2CH_2NH_2$* thereto.

*This compound usually includes ethylenediamine in very small quantities as an impurity.

At about 70° C., a greater part of trichloroethylene was removed and then the impregnated non-woven fabric was allowed to stand in the air at a room temperature of 25° C. and relative humidity of 60% for 24 hours to complete hardening of the silicone. The adhered amount of silicone calculated as solid was 12.9% and the adhered amount of silicone per unit area was 82 g/m$^2$ at this time.

This non-woven fabric was further impregnated with a dimethyl formamide solution of polyurethane containing a black pigment, i.e., 8% of a carbon black preparation based on the solid component of polyurethane, so that the adhered amount of polyurethane calculated as solid might become about 48 parts based on 100 parts of the island components, coagulated in a water bath, removed of polyvinyl alcohol and dried.

Next, the processed non-woven fabric was imparted with 6% to 9%, calculated as solid, of a self-crosslinking type emulsion resin ("Ultrasol—2613", a product of Takeda Pharmaceutical Industries Co. of Japan) added with a small amount of a migration preventing agent with a view to decreasing the number of naps lost, from which the moisture was removed and thereafter the fabric was heat-treated at 140° C. for 6 minutes.

The processed non-woven fabric which had been treated so as to prevent the naps from being lost was sliced in two so that the thickness thereof might become the same. Thereafter, the fabric was processed into a napped non-woven fabric and dyed a deep color according to Example 1.

The dyed product became a product having the capacity of preventing nap from being lost in addition to the appearance, feel and properties of the products of Examples 1 to 3.

The results of testing the product in respect to its capacity to prevent nap from being lost will be shown below.

Properties of products after being treated for preventing nap from being lost.

| T* | S* | M* | PP* Nap losing resistance | PP* Surface properties | PP* Feel |
|---|---|---|---|---|---|
| Example 6 | 12.9 | 0 | Δ | O | O |
| | " | 6.1 | Δ - O | O | O |
| | " | 7.1 | O | O | O |
| | " | 8.8 | O | O | O |
| Control | 7.8 | 0 | Δ | O | O |
| | " | 5.2 | Δ - O | O | O |
| | " | 7.8 | O | O | O |
| | " | 11.6 | O | O | Δ - O |
| | 18.4 | 0 | Δ | O | O |
| | " | 5.1 | Δ | O | O |
| | " | 6.4 | Δ - O | O | O |

-continued

Properties of products after being treated for preventing nap from being lost.

| T* | S* | M* | PP* Nap losing resistance | PP* Surface properties | PP* Feel |
|---|---|---|---|---|---|
| | " | 8.6 | O | O | O |

NOTE:
Nap losing resistance
O: few naps were lost
Δ: a few naps were lost
surface properties and feel
O: good
Δ: somewhat poor
T* Test
S* Adhered amount of silicone (%)
M* Adhered amount of a migration preventing agent (%)
pp* Properties of the product.

EXAMPLE 6

In this example, 5 parts by weight of $(CH_3CH_2CH_2CH_2)_2$-Sn—$(OCOCH_3)_2$ was added to the silicone treating liquid obtained in Example 1. Owing to such an addition, the hardening reaction was completed by dry-heating at 70° to 100° C. for 5 minutes.

The other processes were carried out the same as Example 1, and an excellent product was obtained.

EXAMPLE 7

A part of the non-woven fabric of the "island-in-a-sea" type fiber, from which the sea component had been removed in Example 6 was impregnated with about 250% in wet weight based on the fabric of a reaction type silicone treating liquid prepared as follows:

The reaction type silicone treating liquid consisting of:

(a) 945 parts by weight of trichloroethylene (b) 45 parts by weight of a mixture

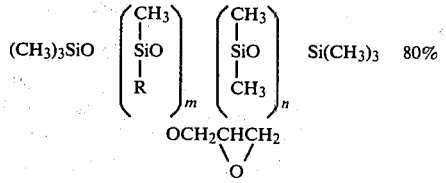

(m = 10 to 20
n = 500 to 700)
(R = propyl)

and: polydimethylsiloxane having terminals of —O-H——20%

(c) 5 parts by weight of partly condensed $CH_3Si(OCH_3)_3$ (d) 5 parts by weight of $(CH_3O)_3$-$Si(CH_2)_3NHCH_2CH_2NH_2$ After the greater part of the trichloroethylene was removed at 70° C., the non-woven fabric was heat-treated at 130° C. for 7 minutes. The adhered amount of silicone per unit area was 88 g/m$^2$.

This non-woven fabric was further impregnated with a dimethyl formamide solution of polyurethane so that the adhered amount of polyurethane might become about 60 parts based on 100 parts of the island components. Thereafter, the non-woven fabric was processed and dyed according to Example 1.

The dyed product had an appearance and properties of a somewhat longer nap, increased luster on the surface, a very soft and plaint feel different from those of the conventional natural leather and artificial suede-like leather products.

EXAMPLE 8

The same fiber as in Example 1 was used in preparing a non-woven fabric of an "islands-in-a-sea" type fiber, from which the sea component was removed all in the same manner as in Example 1. The resultant non-woven fabric was impregnated with about 250% in wet weight of a silicone treating liquid which was reactive upon heating and prepared from the following components:

(a) 907 parts by weight of trichloroethylene (b) 47.5 parts by weight of polydimethylsiloxane having a terminal of —OH and a molecular weight of about 25,000 (25° C., 3000 CS); and (c) 2.5 parts by weight of partly condensed $CH_3Si(OCH_3)_3$ (d) 1.5 parts by weight of:

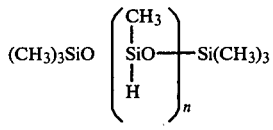

(n = 40 to 60)

(e) 35 parts by weight of methyl alcohol (f) 1.5 parts by weight of: $HS(CH_2)_3Si(OCH_3)_3$ (g) 5 parts by weight of: $(CH_3O)_3Si(CH_2)_3NH(CH_2)_2NH_2$ (h) 0.1 parts by weight of: $(C_4H_9)_2Sn(OCOC_{11}H_{23})_2$ Next, after removing a greater part of trichloroethylene at about 70° C., the fabric was heat-treated at 130° C. for 7 minutes. The adhered amount of silicone calculated as solid was 13.2% and the adhered amount of silicone per unit was 99 g/m$^2$ at this time.

This non-woven fabric was further impregnated with a dimethyl formamide solution of polyurethane containing a black pigment, i.e., about 0.5% of a carbon black preparation based on the solid component of polyurethane, so that the adhered amount of polyurethane would become about 55 parts based on 100 parts of the island components. Thereafter, the non-woven fabric was processed according to Example 1 and dyed in a medium deep color.

The non-woven fabric was dyed in a medium deep color using a dispersed dye under pressure and at a temperature of 125° C. As in Example 1, the color of the product was deep, and the napped product increased in a high-quality feeling and in tint, and having an appearance like that of a woolen woven fabric.

EXAMPLE 9

The same fiber as in Example 1 was used in preparing a non-woven fabric of an "islands-in-a-sea" type fiber, from which the sea component was removed all in the same manner as in Example 1. The resultant non-woven fabric was impregnated with about 250% in wet weight of a silicone treating liquid which was reactive upon heating and prepared from the following components:

(a) 942 parts by weight of trichloroethylene (b) 47.5 parts by weight of polydimethylsiloxane having a terminal of —OH and a molecular weight of about 25,000 (25° C., 3000 CS); and (c) 2.5 parts by weight of partly condensed $CH_3Si(OCH_3)_3$ (d) 5 parts by weight of: $(CH_3O)_3Si(CH_2)_3NHCH_2CH_2NH_2$ (e) 0.0025 parts by weight of: $(C_4H_9)_2Sn(OCOC_{11}H_{23})_2$ After the greater part of the trichloroethylene was removed at about 70° C., the impregnated non-woven fabric was allowed to stand in the air at a room temperature of 25° C. and a relative humidity of 60% for 48 hours to complete the hardening of silicone. The adhered amount of silicone calculated as solid was 12.9% and the adhered amount of silicone per unit area was 96.8 g/m$^2$ at this time.

This non-woven fabric was further impregnated with a dimethyl formamide solution of polyurethane containing a black pigment, i.e., about 0.5% of a carbon black preparation based on the solid component of polyurethane, so that the adhered amount of polyurethane would become about 55 parts based on 100 parts of the island components. Thereafter, the non-woven fabric was processed according to Example 1 and dyed in a medium deep color.

The non-woven fabric was dyed in a medium deep dispersed dye under pressure and at a temperature of 125° C. As in Example 1, the color of the product was deep, and the napped product increased in a high-quality feeling and in tint, and having an appearance like that of a woolen woven fabric.

The composite sheet and its process of preparation, provides a fabric of high quality napped woolen fabric.

Although the foregoing description has included numerous specific Examples, these are intended to be exemplary only, and are not intended to limit the scope of the invention. It will be apparent that equivalent elements may be substituted for those specifically shown and described, that certain features may be used independently of other features, and that in some instances the sequence of method steps may be reversed, all without departing from the spirit and scope of the invention as defined in the appended claims.

We claim:

1. A composite sheet comprising a base portion having a plurality of naps embedded therein and having portions extending therefrom, a plurality of said naps comprising root portions connected to said embedded portions and extending from and free of said base portion and having tip portions extending from said root portion, a plurality of said naps comprising bundles of fine fibers bound at said root portions by a hardened adhesive organic compound, said base portion having an elastomer positioned among the embedded portions of said naps adjacent said root portions, the adherence between said fibers and said hardened organic compound being greater than the adherence between said hardened organic compound and said elastomer, a plurality of the fibers of said root portions being bound to one another by said hardened, adhesive organic compound, said plurality of root portions being substantially free of said elastomer, and a plurality of tip portions having slender or branched ends.

2. The composite sheet in accordance with claim 1 wherein a greater part of said fabric is of superfine fibers of less than 0.7 denier.

3. The composite sheet in accordance with claim 1 wherein said fiber constituting said fabric is polyester.

4. The composite sheet in accordance with claim 1 wherein said hardened high molecular weight organic compound is a hardened high molecular weight organosilicone compound.

5. The composite sheet in accordance with claim 4 wherein said hardened high molecular weight organosilicone compound is silicone rubber.

6. The composite sheet in accordance with claim 1, wherein said elastomer is polyurethane.

7. The composite sheet in accordance with claim 1, wherein said fabric is a non-woven fabric.

8. The composite sheet in accordance with claim 1, wherein said hardened high molecular weight organic compound and said elastomer comprise a total of 15 to 70 parts by weight based on the base portion of said composite sheet as a whole being 100 parts by weight.

9. The composite sheet in accordance with claim 8, wherein 0.5 to 50 parts by weight of said hardened high molecular weight organic compound are contained per 100 parts by weight of the elastomer.

10. The composite sheet in accordance with claim 9, wherein 0.5 to 20 parts by weight of said hardened high molecular weight organic compound are contained per 100 parts by weight of said high molecular weight elastomer.

11. The composite sheet of claim 1, wherein a plurality of said tip portions include at least some individually separate fibers.

12. A composite sheet comprising bundles of fine fibers of the polyester series bound with silicone rubber and polyurethane forming a base positioned among and adjacent said bundles, and from which said bundles extend free of said polyurethane, a greater part of said fine fibers being of less than 0.7 denier, wherein the adherence between the fibers and the silicone rubber is greater than the adherence between the silicone rubber and the polyurethane, the surface of said sheet including a plurality of naps of said bundles, a plurality of said naps having slender or branched ends.

13. A process for preparing a composite sheet comprising a base portion having a plurality of naps extending therefrom, a plurality of said naps comprising root portions connected to said base portion and having tip portions extending from said root portions, said root portions comprising bundles of fine fibers bound with a hardened organic compound and said base portion having an elastomer positioned among and adjacent said bundles, said tip portions comprising slender or branched fine fibers, wherein the adherence between the fibers and the hardened organic compound is greater than the adherence between the hardened organic compound and the elastomer, impregnating said hardenable organic compound into a sheet which is mainly composed of bundles of separable fine fibers, impregnating said sheet with said elastomer and buffing and/or raising said sheet to form said naps of said fiber bundles into slender or branched ends at least some of which comprise separated fine fibers, a plurality of said root portions being substantially free of said elastomer.

14. The process for preparing a composite sheet in accordance with claim 13, wherein said fabric is composed mainly of bundles of superfine fibers of less than 0.7 denier.

15. The process for preparing a composite sheet in accordance with claim 14, wherein each of said bundles of superfine fibers is obtained by removing from an "islands-in-a-sea" type multi-component fiber, the sea component.

16. The process for preparing a composite sheet in accordance with claim 15, wherein the island component of said "islands-in-a-sea" type multi-component fiber is a polymer of polyester or of the polyesterether series and the sea component of said fiber is a polymer of the polystyrene series.

17. The process for preparing a composite sheet in accordance with claim 13, wherein said hardenable high molecular weight organic compound is a hardenable polyorganosilicone compound.

18. The process for preparing a composite sheet in accordance with claim 17, wherein said hardenable polyorganosilicone compound is silicone rubber forming polyorganosiloxane.

19. The process for preparing a composite sheet in accordance with claim 13 wherein said elastomer is polyurethane.

20. The process for preparing a composite sheet in accordance with claim 13, wherein said fabric is a non-woven fabric.

21. The process in accordance with claim 13, wherein said separable fibers are fibrillated by dynamically strong rubbing.

22. In a process for preparing a composite sheet having a base portion having a plurality of naps extending therefrom, a plurality of said naps comprising root portions connected to said base portion and having tip portions extending from said root portions, which process comprises the steps of:

forming a web using a greater part of a multicomponent fiber which is separable and can become a bundle of superfine fibers;

tangling said web to obtain a non-woven fabric;

maintaining said separable fibers as coherent bundles;

unbinding said fibers while maintaining said fibers as bundles;

impregnating said fabric with polyorganosiloxane;

hardening said polyorganosiloxane to form silicone rubber thereby adhering said fibers to one another;

impregnating said fabric with polyurethane;

the adherence between the fibers and the silicone rubber being greater than the adherence between the silicone rubber and the polyurethane; and buffing and/or raising at least one surface of the resulting sheet to form said tip portions having slender or branched ends, at least a plurality of said root portions being substantially free of polyurethane but bound with said silicone rubber, said base including silicone rubber bound bundles with polyurethane positioned among said bundles.

23. The process defined in claim 22, wherein said step of buffing and/or raising includes the step of separating a plurality of fibers from one another in said tip portions.

24. The process defined in claim 23 wherein said buffing and/or raising step comprises removing substantially all of said elastomer from said slender or branched ends of the fiber bundle.

* * * * *

UNITED STATES PATENT AND TRADEMARK OFFICE

CERTIFICATE OF CORRECTION

PATENT NO. : 4,318,949

DATED : March 9, 1982

INVENTOR(S) Miyoshi Okamato et al

It is certified that error appears in the above—identified patent and that said Letters Patent is hereby corrected as shown below:

Column 10, after line 24, on the next line insert the following:

b.

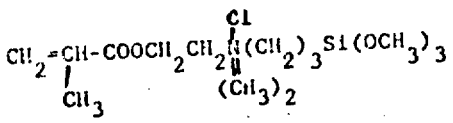

c.

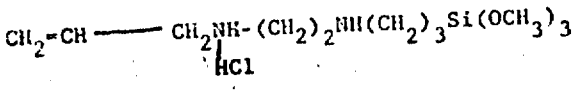

In Table I, Column 13, under "107" insert --100--.
under "116" delete "100".
under "B*" delete "164".
under "116" insert --164--.

Column 17, after Line 68, insert the following line:

--" 8.6 ○ ○ ○ --.

Signed and Sealed this

Sixth Day of July 1982

[SEAL]

Attest:

GERALD J. MOSSINGHOFF

Attesting Officer

Commissioner of Patents and Trademarks